US005747918A

United States Patent [19]

Eom et al.

[11] Patent Number: 5,747,918

[45] Date of Patent: May 5, 1998

[54] DISPLAY APPARATUS COMPRISING DIAMOND FIELD EMITTERS

[75] Inventors: Chang-Beom Eom, Durham, N.C.; Sungho Jin, Millington, N.J.; Gregory Peter Kochanski, Dunellen, N.J.; Mark Thomas McCormack, Summit, N.J.; Yiu-Huen Wong, Summit, N.J.

[73] Assignee: Lucent Technologies Inc., Murray Hill, N.J.

[21] Appl. No.: 567,867

[22] Filed: Dec. 6, 1995

Related U.S. Application Data

[63] Continuation of Ser. No. 220,077, Mar. 30, 1994, abandoned.

[51] Int. Cl.[6] ..... H01J 1/30

[52] U.S. Cl. ..... 313/309; 313/336; 313/351; 315/169.3; 315/169.4

[58] Field of Search ..... 313/309, 310, 313/311, 336, 351; 315/169.3, 169.4; 428/690

[56] References Cited

U.S. PATENT DOCUMENTS

| | | | |
|---|---|---|---|
| 4,008,412 | 2/1977 | Yuito et al. | 313/309 |
| 4,325,000 | 4/1982 | Wolfe et al. | 313/336 |
| 4,482,838 | 11/1984 | Ishii et al. | 313/336 |
| 4,663,559 | 5/1987 | Christensen | 313/336 |
| 4,683,399 | 7/1987 | Soclof | 313/309 |
| 4,766,340 | 8/1988 | van der Mast et al. | 313/309 |
| 5,019,003 | 5/1991 | Chason | 313/309 |
| 5,038,070 | 8/1991 | Bardai et al. | 313/309 |
| 5,129,850 | 7/1992 | Kane et al. | 445/24 |
| 5,138,237 | 8/1992 | Kane et al. | 315/349 |
| 5,229,682 | 7/1993 | Komatsu | 313/309 |
| 5,278,475 | 1/1994 | Jaskie et al. | 313/311 |
| 5,283,500 | 2/1994 | Kochanski | 315/58 |
| 5,371,431 | 12/1994 | Jones et al. | 313/336 |

FOREIGN PATENT DOCUMENTS

| | | | |
|---|---|---|---|
| 376825 | 7/1990 | European Pat. Off. | 313/309 |

OTHER PUBLICATIONS

"Field–Emitter Arrays Applied to Vacuum Fluorescent Display", by C. A. Spindt et al., *IEEE Transactions on Electron Devices*, vol. 36, No. 1, Jan. 1989, pp. 225–228.

"Late–News Paper: Field–Emission Displays Based on Diamond Thin Films", by N. Kumar, *SID Digest*, pp. 1009–1011 (1993).

"The Formation and Characterization of Rare Earth Boride Films", by J. G. Ryan et al., *Thin Solid Films*, vol. 135, pp. 9–19 (1986).

"Diamond May Prove Ideal Display Screen", by M. W. Browne, *The New York Times*, Sep. 28, 1993 (3 pages total).

*Primary Examiner*—Sandra L. O'Shea
*Assistant Examiner*—Matthew J. Esserman
*Attorney, Agent, or Firm*—Eugen E. Pacher

[57] ABSTRACT

A novel and advantageous cathode structure for a field emission display apparatus is disclosed. A given pixel comprises a multiplicity of spaced apart emitter bodies on a support. A given emitter body comprises diamond and/or rare earth boride, and has a relatively sharp geometrical feature that facilitates electron emission from the emitter body. By way of example, the emitter body comprises diamond bodies grown on a support, or it comprises a pre-existing diamond particle that was placed on the support. Such emitter bodies generally can be provided easily and at low cost, and typically have naturally occurring sharp geometrical features such as points and edges. We have also discovered that appropriately grown rare earth boride films of thickness 30 nm or less may substantially improve electron emission from emitter bodies, and some preferred embodiments of the invention comprise a cathode structure that comprises a thin layer of, e.g., $LaB_6$ on the emitter bodies. Methods of making cathodes according to the invention are also disclosed.

13 Claims, 5 Drawing Sheets

DISPLAY APPARATUS COMPRISING DIAMOND FIELD EMITTERS

This application is a continuation of application Ser. No. 08/220,077, filed on Mar. 30, 1994, now abandoned

FIELD OF THE INVENTION

This invention pertains to apparatus, typically display apparatus, that comprises field emitters, typically field emitters that comprise diamond and/or rare earth (RE) boride.

BACKGROUND OF THE INVENTION

Flat panel field emission displays are known. See, for instance C. A. Spindt et al., *IEEE Transactions on Electron Devices*, Vol. 36 (1), p. 225. Prior art displays typically comprise sharp-tip metal electron emitters, e.g., Mo cones having a tip radius of the order of a few tens of nanometers. However, such emitters have proven to be insufficiently durable for many applications, due, for instance, to the occurrence of a localized arc discharge that frequently damages the tip and may cause thermal runaway. The arc is typically occasioned by, e.g., desorption of gas (possibly also decomposition of oxides, etc.) from the surface, with resulting rise in the local gas pressure to a level that supports initiation of the arc. Emitter damage may also result from mass transport towards the emitter tip that results from the presence of a strong temperature gradient and electric field that are typically present in an activated emitter. The mass transport tends to increase the tip radius, decreasing the current emitted from the tip at a given applied voltage.

U.S. Pat. No. 5,129,850 discloses a field emitter having a coating of diamond material disposed on an appropriately shaped surface of a conductive/semiconductive material. The emitter is formed by a process that involves implantation of carbon ions into the surface of an appropriately shaped substrate to create nucleation sites for diamond formation, forming diamond, depositing a conductive layer over the diamond, and removing the substrate.

U.S. Pat. No. 5,138,237 discloses a field emission device that comprises diamond-containing emitters. The diamond body of a given emitter is formed by selective etching of a previously deposited diamond film.

N. Kumar et al., *SID Digest*, pp. 1009–1011 disclose field emission displays based on amorphic diamond thin films. The film is formed by laser ablation, with the electron emission properties of the (structureless) diamond film said to strongly depend on the deposition process and conditions.

Diamond has properties that make it desirable for field emission means. However, the prior art approaches to using diamond for such means have shortcomings. For instance, the approaches of the above cited U.S. patents are complex, exemplarily involving a difficult diamond etching step. On the other hand, the approach of Kumar et al. is strongly dependent on manufacturing conditions. Such strong dependence is typically undesirable.

It would be highly desirable to have available readily manufacturable improved field emission means free of, or at least less subject to, the shortcomings of the prior art means. This application discloses such means.

SUMMARY OF THE INVENTION

In a broad aspect the invention is embodied in improved field emission display apparatus that comprises a novel multipixel cathode. A given pixel of the cathode comprises a multiplicity of spaced apart emitter bodies on a support. A given one of the emitter bodies of the given pixel comprises material selected from the group consisting of diamond and RE borides (e.g., $LaB_6$) and has a relatively sharp (edge-like or pointed) feature effective for facilitating electron emission from the emitter body. Both diamond and RE borides have high melting points and are covalently bonded, and consequently are very stable materials.

The emitter body typically but not necessarily is in contact with conductive material that facilitates flowing a current from an external current source to the emitter body. The relatively sharp features are typically naturally occurring (i.e., not formed by, e.g., etching or other shape-changing process), but may be formed or enhanced by appropriate processing, typically prior to placement of the particle on the support means. For instance, it is known that diamond microcrystallites can be grown on polyhedral diamond particles by, e.g., chemical vapor deposition.

In addition to the above described novel cathode, the apparatus typically comprises an anode that is spaced apart from the cathode and comprises light emitting means (typically a phosphor), a gate disposed between anode and cathode, and means for applying a voltage between cathode and gate such that electrons are emitted from at least some of the emitter bodies and impinge on the light emitting means. The latter features of the apparatus can be conventional.

DETAILED DESCRIPTION OF SOME PREFERRED EMBODIMENTS

A significant aspect of the invention is the presence, in a given pixel of the cathode of a display according to the invention, of a multiplicity (typically hundreds or even thousands) of separate, substantially randomly disposed emitter bodies, exemplarily in situ grown diamond "islands" or pre-existing particles, typically diamond particles or RE boride particles. In either case, the emitter bodies are coupled to appropriate circuitry such that a current can be caused to flow between the emitter bodies and the anode.

Coupling can be by means of contact with electrically conductive material, or can be capacitive. Those skilled in the art will appreciate that in the case of capacitive coupling the primary current path is capacitive, but that means that support the flow of a conduction current to the emitter body (in order to replace the electrons that are emitted from the body) have to be provided. Such means are frequently referred to as a "leaky" dielectric. Such material exemplarily has a resistivity in the range $10^6$–$10^9$ Ω·cm. Many, if not all of the emitter bodies have relatively sharp geometrical features (edges and/or point-like features) which facilitate electron emission in response to an applied electric field. Although the emitter bodies are generally spaced apart, it is not precluded that some of them touch. Typically less than about 80% (frequently less than 50%) of a pixel area is occupied by emitter bodies.

Figure 1:
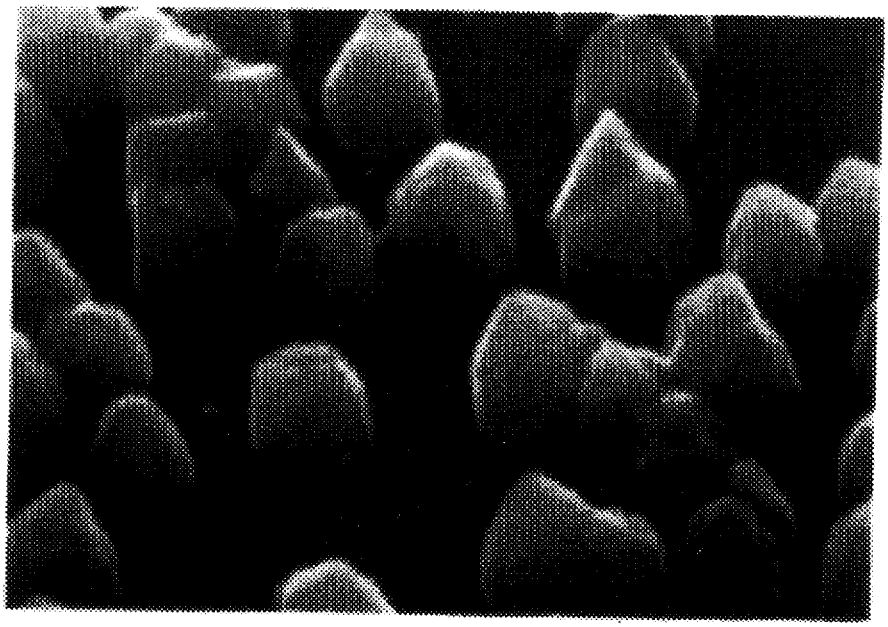
FIGS. 1 and 2 are SEM micrographs that depict diamond particles grown on a substrate.

FIG. 1 is a SEM micrograph showing diamond islands that were grown in situ by plasma enhanced chemical vapor deposition (using a methane/hydrogen gas mixture) on a (100) silicon substrate. As can be clearly seen, the islands typically have polyhedral shape, relatively uniform size and height, and are substantially randomly disposed. A substantial fraction of the islands has naturally occurring relatively sharp geometrical features. This aspect is further illustrated by FIG. 2, which shows a magnified portion of FIG. 1. The micrograph shows a sharply pointed particle, the point having a radius of curvature of a few tens of nanometers.

The relative uniformity of size and height of diamond islands (as well as of commercially available diamond particles) is an advantageous feature that facilitates flat panel display construction. In particular, it facilitates cathode/gate formation using a convenient planarizing method (to be described below) instead of the conventionally used lithographic processing.

Figure 3:
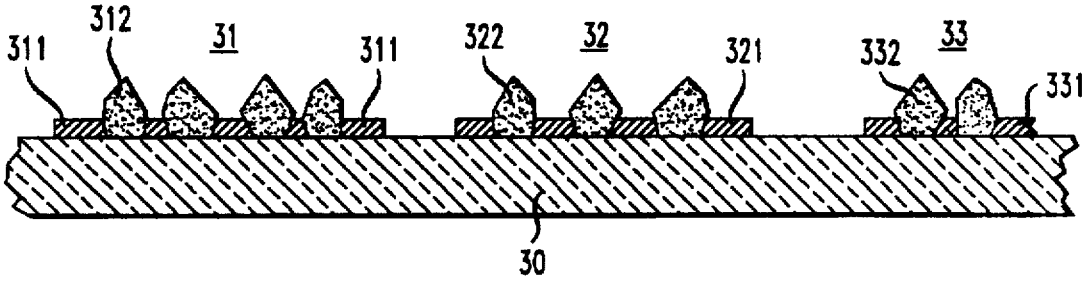
FIGS. 3–5 schematically depict respectively portions of a cathode structure according to the invention, with FIG. 3 showing in situ grown particles, and FIGS. 4–5 showing pre-existing particles embedded in a conductive medium.
Figure 4:
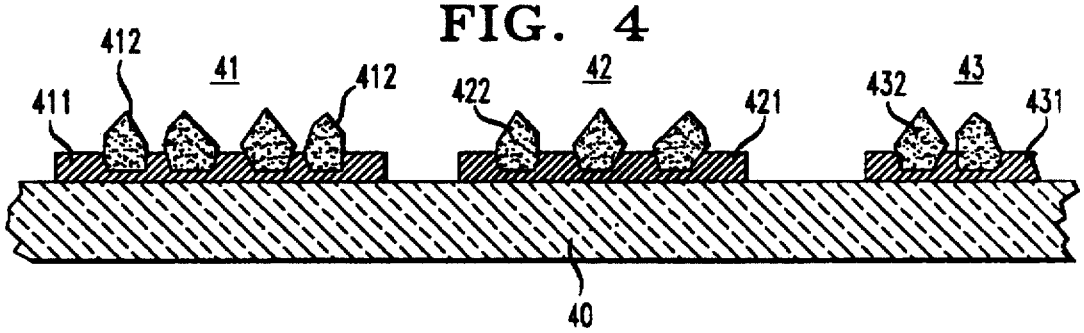
Figure 5:
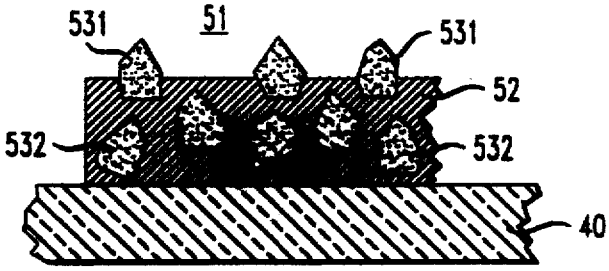

FIGS. 3–5 schematically depict relevant portions of cathode structures according to the invention. In FIG. 3, numeral 30 designates an appropriate substrate, e.g., a (100)-oriented Si wafer, and numerals 31–33 designate three pixels, respectively. Each pixel comprises a multiplicity of in situ grown diamond particles (e.g., 312) in contact with conductor material (e.g., 311). In FIG. 4, numeral 40 refers to an appropriate substrate (e.g., a glass plate), numerals 41–43 refer to three pixels, respectively. Each pixel comprises a conductor layer (e.g., 411), with a multiplicity of pre-existing diamond particles (e.g., 412) embedded therein and protruding therefrom. FIG. 5 shows, for simplicity's sake, a single pixel only. The pixel comprises conductor material 52, with some pre-existing diamond particles (e.g., 532) completely embedded therein, and some of the diamond particles (e.g., 531) embedded therein and protruding therefrom.

Those skilled in the art will appreciate that in other embodiments a leaky dielectric may be substituted for the conductive material (e.g., 311, 411, 52), with a layer of conductive material sandwiched between the substrate (e.g., 30, 40) and the leaky dielectric. Furthermore, if the substrate is a Si wafer or other suitable semiconductor body, a separate conductor layer may not be necessary, since the semiconductor body can be doped to provide conduction as well as isolation between pixels. For instance, a n-type Si wafer can be ion implant-doped to provide p-type stripes which define the pixels. The resulting p-n junctions can, in known manner, provide isolation between pixels.

A flat panel display device typically comprises thousands of pixels. Exemplarily, a pixel is of size 100 μm×100 μm, and the emitter bodies (e.g., diamond particles) exemplarily are of approximate size 1 μm, typically in the range 0.1–20 μm. Particles smaller than the lower limit typically are difficult to process. The upper size limit typically is determined by the pixel size and the requirement that each pixel comprises a multiplicity of activatable emitter bodies. The "size" of a polyhedral particle of the type that is of interest herein is the diameter of a sphere of volume equal to that of the particle.

In FIGS. 3–5 no details of the cathode circuitry are shown. This circuitry can be conventional. See, for instance, U.S. Pat. No. 5,283,500, incorporated herein by reference.

Diamond emitter bodies according to the invention can be islands that are grown in situ on a substrate by any appropriate diamond growth process (e.g., chemical vapor deposition, flame deposition, hot filament technique). It is known that growth of diamond film on a substrate commences at nucleation sites of the substrate, resulting in the formation of diamond islands which, if deposition is continued long enough, coalesce into a continuous polycrystalline diamond film. However, growth conditions can be selected such that the multiplicity of islands does not coalesce into a continuous film but that a multiplicity of spaced apart substantially crystalline (i.e., $sp^3$-dominated) polyhedral diamond islands is formed. The term "$sp^3$-dominated" means that the material of the islands substantially has four-fold co-ordinated, covalently bonded diamond structure.

An important aspect of the choice of growth conditions is the preparation of the substrate surface to provide an appropriate density of nucleation sites. This preparation can be by any appropriate method, e.g., by polishing with diamond grit. Exemplarily, the preparation conditions are selected to result in a nucleation site density in the approximate range $0.1$–$2.0\times10^8/cm^2$. Since the rate of formation of nucleation sites will typically depend on the details of the process used, it is not possible to recite generally applicable process parameter ranges. However, it will typically only require a minor amount of routine experimentation to determine process parameters that result in a suitable density of nucleation sites.

After preparation of the substrate surface, diamond islands are grown on the substrate. Growth typically is terminated well before substantial coalescence of the islands, resulting in a multiplicity of spaced apart, polyhedral diamond islands on the substrate. Many, if not all, of the islands will naturally have relatively sharp geometrical features, with at least some of the islands oriented such that the sharp features facilitate emission of electrons from the particles. Optionally the islands are formed in predetermined regions of the substrate, such that the desired array of pixels results. Such patterned deposition can be readily accomplished by means of, e.g., an appropriate mask. Alternatively, a uniform distribution of islands is formed on the substrate, followed by patterning to yield the desired array of pixels. The average distance between neighboring islands is desirably at least half of the average island size, and preferably is equal to or greater than the latter. The spacing between islands facilitates provision of conductive paths to the islands, which in turn facilitates supplying current to the islands. The above remarks apply equally to other emitter bodies such as pre-existing diamond particles or rare earth boride particles.

In situ growth of emitter bodies is not the only possible approach to making cathode structures according to the invention. Another approach utilizes pre-existing particles, e.g., natural or synthetic diamond grit or powder. Such particles also typically have relatively sharp geometrical features that can facilitate electron emission, and are readily commercially available at low cost. Furthermore, such particles can readily be disposed on a substrate in a desired pattern by known techniques, e.g., screen printing or powder sprinkle coating. Spray coating or spin coating, followed by patterning, are also contemplated. Exemplarily the particles are carried in a liquid medium (e.g., acetone, alcohol, water), optionally with organic binder (to be pyrolysed later). Optionally, other particles (e.g., metal flakes) can also be present. Exemplarily the other particles are solder particles, the mixture is spray coated onto the support means, followed by heating of the support means to melt the solder.

Diamond is not the only material contemplated for emitter particles. Among other suitable materials are rare earth (Y and elements of atomic number 57–71) borides, e.g., Y-boride and La-boride. These have, in addition to the required sharp features, also relatively low electron work function, further facilitating electron emission. Suitable rare earth (RE) boride particles can be produced, for instance, by mechanical fracturing of commercially available bulk crystalline material.

RE-borides such as $YB_6$ or $LaB_6$ not only can have low electron work function but also are relatively good electrical conductors. On the other hand,pure diamond is an insulator. Consequently, preferred diamond-comprising emitter bodies comprise either diamond that is doped (either n-type or p-type; either throughout the volume of the body or only in the surface region) to increase the conductivity, or that comprise a thin conductive layer thereon. An exemplary suitable dopant is boron. Other dopants (e.g., nitrogen, phosphorus) may also be suitable. A conductive layer (e.g., a $LaB_6$ layer) can be applied by any suitable physical or chemical deposition technique, e.g., sputtering, evaporation, laser ablation, plasma spraying, electrodeposition, electroless deposition or chemical vapor deposition. Graphitization of a surface layer can also provide a conductive layer and is contemplated. Exemplarily, diamond particles are subjected, in known manner, to partial graphitization prior to their placement on the support means.

Bulk RE borides such as $YB_2$, $YB_4$, $YB_6$, and $LaB_6$ etc. are known to have low resistivity ($\rho$) and work function ($\phi$). It is also known that thin films of RE borides typically have work functions that are substantially larger than those of the corresponding bulk material. See, for instance, J. G. Ryan et al., *Thin Solid Films*, Vol. 135, pp. 9–19 (1986), disclosing that bulk $LaB_6$ has $\rho$=17 $\mu\Omega$ cm and $\phi$=2.66 eV, and that thin films of $LaB_6$ have $\rho$=96 $\mu\Omega$ cm and $\phi$=3.8 eV. Thus, the prior art does not suggest the use of thin RE boride films to enhance the emission properties of emitter bodies according to the invention.

We have made the surprising discovery that, under appropriate conditions, RE boride films can have $\phi$ substantially lower than taught by the prior art, such that application of a RE boride film may substantially improve the emission characteristics of emitter bodies according to the invention.

Figure 8:
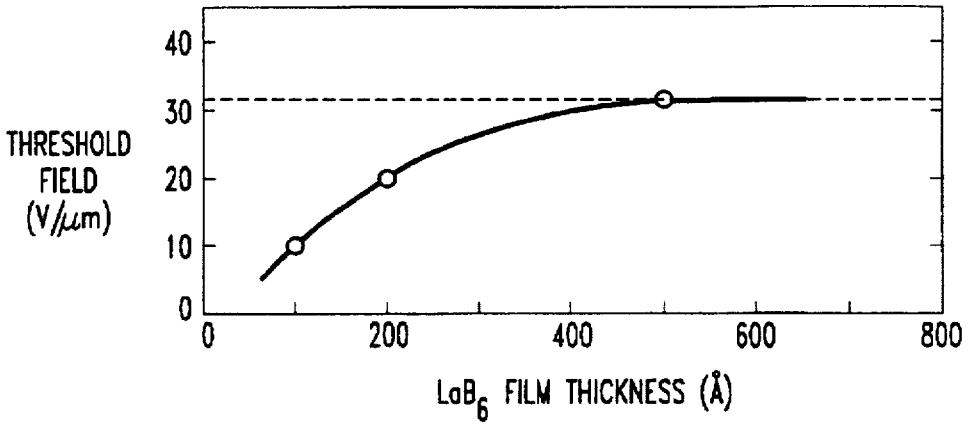
FIG. 8 shows preliminary data on threshold voltage vs. $LaB_6$ film thickness.

FIG. 8 shows exemplary preliminary data on threshold voltage for electron emission from B-doped diamond islands according to the invention as a function of thickness of a $LaB_6$ coating, with the broken line showing results from bare diamond islands, and the solid line showing results from analogous $LaB_6$-coated islands. FIG. 8 shows a strong dependence of threshold voltage on coating thickness, with coatings of thickness $\leqq$ 30 nm resulting in significant lowering. Similar results are expected for other RE borides. Thus, in some preferred embodiments the thickness of RE boride coating is less than about 30 nm, preferably less than 20 nm or even 10 nm.

The effectiveness of RE boride coatings not only depends on coating thickness but also on coating deposition conditions. For instance, a 10 nm thick $LaB_6$ coating formed by magnetron sputtering at a substrate temperature of 500° C. resulted in significant lowering of the emission threshold, whereas a similar coating, deposited at room temperature exhibited more than forty times higher resistivity, and did not significantly lower the emission threshold.

Figure 6:
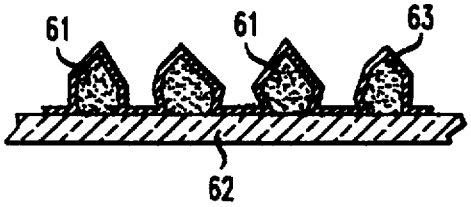
FIGS. 6–7 schematically show cathode structures according to the invention that respectively comprise a conductive and/or low work function layer.

FIG. 6 schematically depicts emitter bodies 61 (e.g, polyhedral diamond islands) on appropriate substrate means 62 (e.g., a Si wafer), with a thin coating 63 of conductive material thereon. In preferred embodiments the coating material furthermore has low work function, thereby facilitating electron emission from the emitter bodies. Such a coating can be applied by known means, e.g., sputtering, evaporation, laser ablation, plasma spray, electrodeposition, electroless deposition, or chemical vapor deposition. Exemplary of suitable layer materials are $LaB_6$, $YB_6$ and $YB_4$.

Figure 7:
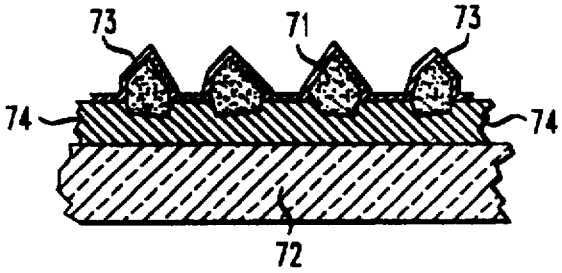

FIG. 7 schematically shows a further exemplary embodiment, with numerals 71–74 referring, respectively, to emitter bodies (e.g. polyhedral diamond particles), substrate (e.g., glass plate), low work function material coating, and conductor (e.g., metal) layer.

Figure 9:
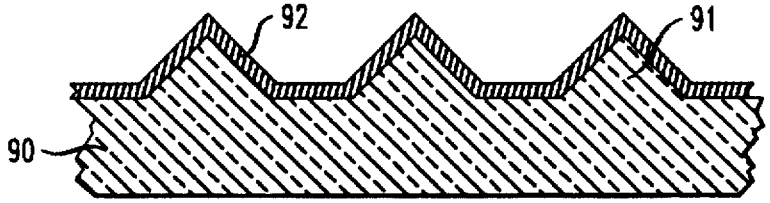
FIG. 9 depicts schematically a cathode structure that comprises emitters formed by an appropriate shaping operation, e.g., anisotropic etching, followed by application of a low work function film.

Those skilled in the art will appreciate that use of the novel low-$\phi$ RE boride coatings is not limited to polyhedral emitter bodies as disclosed above. Such coatings typically can be applied to other micro-emitters, e.g., prior art Mo emitters or diamond film emitters. Furthermore, availability of such coatings facilitates use of novel emitters, e.g., etch patterned Si emitters of the type schematically depicted in FIG. 9, wherein numerals 90–92 refer, respectively, to a Si substrate, to micro-emitters formed from substrate material by selective etching, and to the $\phi$-lowering RE boride layer.

Figure 10:
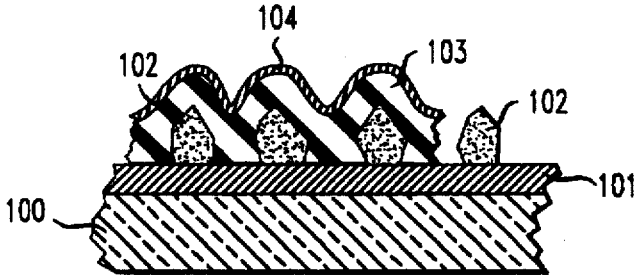
FIGS. 10–12 schematically illustrate stages in the manufacture of an exemplary apparatus according to the invention.
Figure 11:
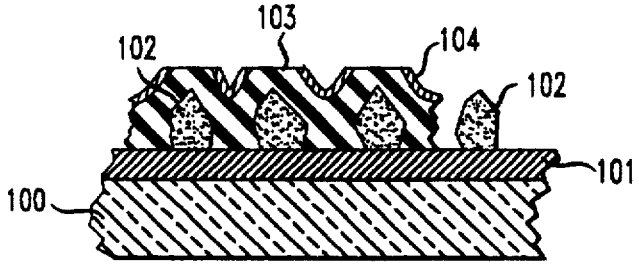
Figure 12:
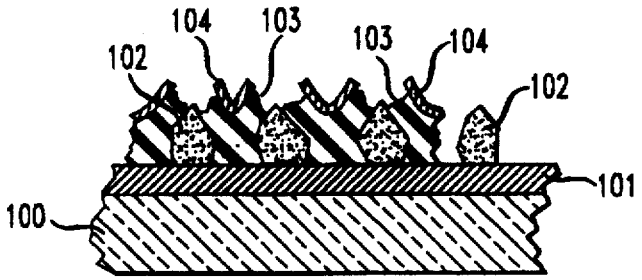

Emitter structures according to the invention can be made by any appropriate method. Some aspects of an exemplary method are schematically depicted in FIGS. 10–12. On quartz glass plate 100 is formed a circuitry layer 101 as taught by the prior art. On predetermined regions of the circuitry layer are positioned emitter bodies 102 according to the invention, e.g., doped diamond islands. A conformal insulating layer 103 is deposited on at least the predetermined regions. The layer thickness is preferably approximately equal to the emitter body size. For layers of thickness $\leqq$2 μm the layer material exemplarily has composition $SiO_xN_y$, deposited by plasma enhanced chemical vapor deposition. Such layers are known. Exemplarily x and y are about 0.2 and 0.8, respectively. Thicker layers exemplarily are electrophoretically deposited glass. On the conformal insulating layer is then deposited a conductive film 104, e.g., a Cr film. The portions of the conductive film that directly overlie the tops of the emitter bodies can be removed by polishing, exposing the insulating material. See FIG. 11. Alternatively a (not shown) fusible material (e.g., a soda-lime glass) is deposited (e.g., electrophoretically) on the conductive film, and the combination is heated to melt the fusible material, such that surface tension can pull the fused material into the valleys of the conductor-covered surface. After solidification of the fused material the surface will be substantially planarized. Isotropically etching the re-solidified material can remove the re-solidified material above emitter bodies while retaining some re-solidified material in the valleys between emitter bodies. Using the remaining re-solidified material as an etch mask, the conductive film is patterned by removing the conductive material that overlies the emitter bodies, while retaining the conductive film in the valleys between the emitter bodies. In either of the two alternative approaches, the patterned conductive layer serves as etch mask for selective removal of the conformal insulating material to expose the emitter body tips. The remaining portions of the conductor film form the gates for the field emission device. See FIG. 12. An anode structure can be provided by conventional means.

Figure 15:
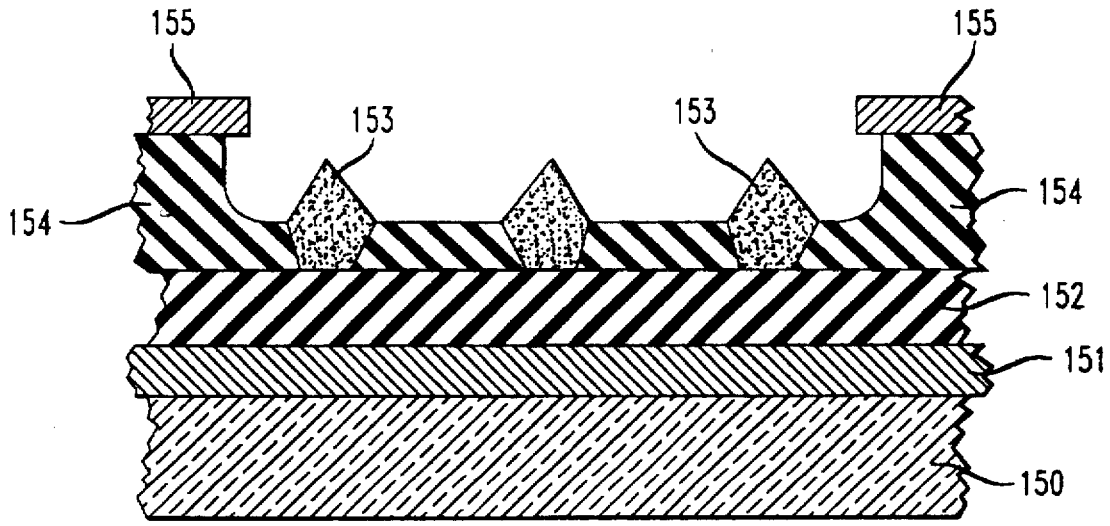
FIG. 15 schematically depicts another exemplary embodiment of the invention.

A further exemplary method is as follows: On a glass substrate is deposited a metal layer (e.g. 0.3 μm Ta) followed by deposition of an insulator layer (e.g., 1 μm $Ta_2O_{5-x}$). On the insulator layer are provided emitter bodies according to the invention, e.g., doped diamond islands of average size 1 μm. The surface is planarized with an insulator (e.g., electrophoretically deposited soda-lime glass or spin-on glass), and the gate metal layer is deposited. Frequently it may be advantageous to select the deposition conditions such that the metal is under tensile stress, to prevent shorting between emitter bodies and gate during device operation. The gate metal is patterned by conventional means, followed by etching of the insulator such that the emitter bodies are exposed. Preferably the thus produced patterned surface comprises "pillars" of the insulator material that support the gate metal layer, as shown schematically in FIG. 13. FIG. 15 schematically depicts a structure as described, wherein numerals 150–155 refer, respectively, to the substrate, metal layer, leaky insulator layer diamond emitter bodies, insulator layer and gate metal layer.

Figure 13:
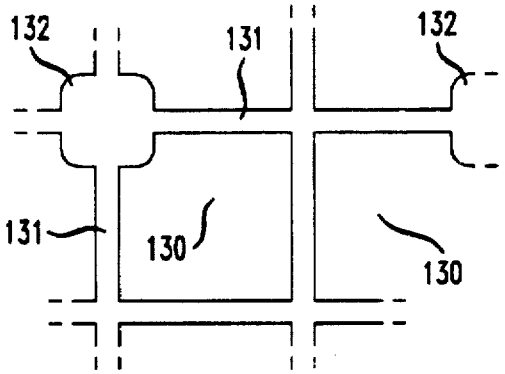
FIG. 13 schematically shows a portion of an exemplary cathode structure in top view.

FIG. 13 schematically shows an exemplary portion of a pixel in top view, with numerals 130 referring to sub-regions of the pixel comprising emitter bodies (not shown). Numerals 131 and 132 refer to the patterned gate metal layer. Exemplarily, etching of the dielectric is carried out such that mask undercutting occurs, with grid arms 131 being supported substantially only by pillars 132. By way of example, sub-regions 130 measure about 5×5 μm, grid arms 131 are about 1.5 μm wide, and pillars 132 are about 3 μm in diameter.

Those skilled in the art will appreciate that in the above described method the emitter bodies are capacitively coupled to the drive circuitry, as disclosed for instance in U.S. Pat. No. 5,283,500.

In an alternative method, an appropriate metal (e.g., commercially available solder or brazing material for diamond bonding) is sputter deposited on the insulator layer, diamond powder is sprayed thereon and the combination heated until the metal layer wets the diamond particles. The remainder of the method is substantially as described above. A thin layer of low work function material (e.g., $LaB_6$) will frequently be deposited on the emitter bodies before application of the conformal coating or the planarizing layer, as the case may be.

Figure 14:
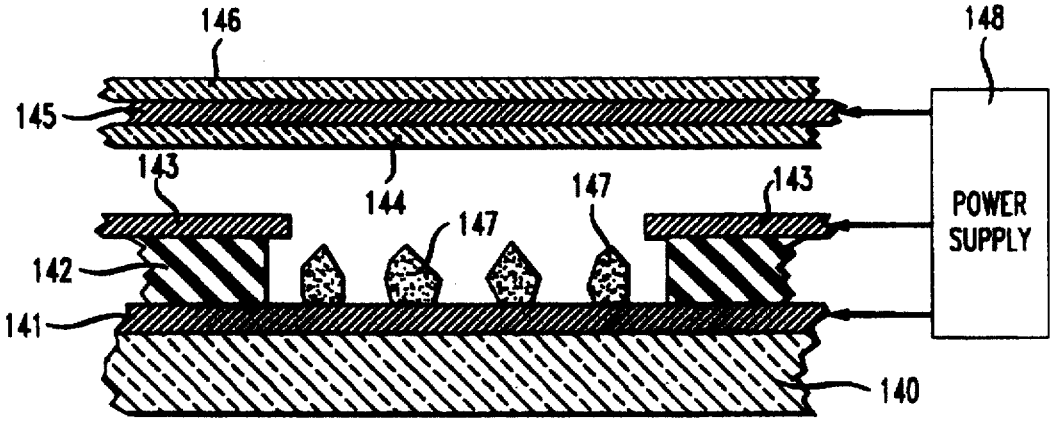
FIG. 14 schematically depicts a portion of an exemplary flat panel display according to the invention.

FIG. 14 schematically shows a portion of an exemplary flat panel display according to the invention. Numeral 140 refers to the substrate, 141 to the cathode conductor layer, 142 to a dielectric spacer layer, and 143 to the gate conductor layer. Furthermore, numeral 144 refers to the phosphor layer, 145 to the anode conductor layer, and 146 to the anode substrate, exemplarily part of the glass envelope of the display. Numeral 148 refers to an electrical power source that provides the requisite voltages and current.

EXAMPLE 1

Figure 2:
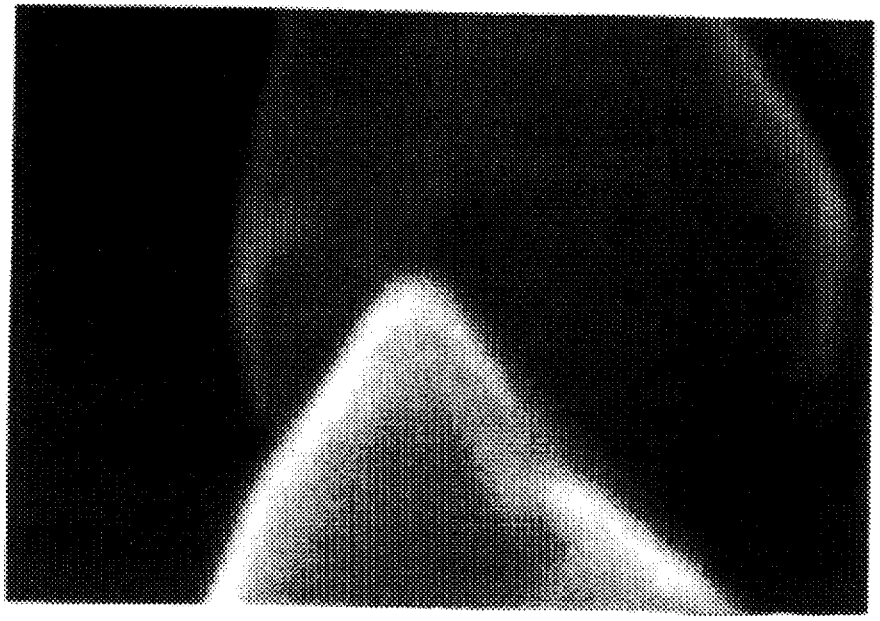

A (001) oriented Si wafer was polished with diamond grit (~1–3 μm size) for about 4 minutes to create an appropriate number of nucleation sites. On the thus prepared substrate were grown diamond "islands" by conventional plasma-enhanced chemical vapor deposition at about 900° C. The atmosphere was 1% $CH_4$in $H_2$, pressure was 40 Torr, and deposition time was 7 hours. The resulting islands were substantially as shown in FIGS. 1 and 2, covering about 50% of the substrate area, and generally having polyhedral shape, with naturally occurring points and edges. Subsequent to island growth the wafer was doped with boron by ion implantation ($10^{15}/cm^2$), using a commercially available ion implanter. Field emission of electrons was observed at a nominal field of about 31 volt/μm at 1mA/$cm^2$ current density. The "nominal" field is the applied voltage divided by the emitter/anode distance.

EXAMPLE 2

Diamond islands were formed substantially as described in Example 1. Subsequent to island growth the wafer was heat treated at 850° C. For 60 hours in 1 atmosphere of $NH_3$. The treatment resulted in enhanced conductivity of the diamond particles. Field emission of electrons was observed at a nominal field of about 75 V/μm at 1 mA/$cm^2$ current density.

EXAMPLE 3

Diamond islands were formed substantially as described in Example 1. The emitter bodies were not intentionally doped. No electron emission was observed up to nominal fields of about 300 V/μm.

EXAMPLE 4

Diamond powder, of approximate size 0.5–1.0 μm and generally polyhedral shape, was treated in 1 atmosphere $NH_3$ for 60 hours at 850° C. and spray coated uniformly onto indium foil by conventional means, and embedded in the foil by pressing. Field emission was observed at about 35V/μm at 1mA/$cm^2$ current density.

EXAMPLE 5

$LaB_6$ powder, of approximate size 10 μm and generally polyhedral shape, was obtained from Johnson Matthey Corporation. The powder was sprinkled onto indium foil and was embedded into the foil by pressing. Final coverage was at least about 60%. Field emission was observed at a nominal field of about 14V/μm at 1 mA/$cm^2$ current density.

EXAMPLE 6

A wafer with B-doped diamond islands was prepared substantially as described in Example 1. A $LaB_6$ film was deposited uniformly over the wafer surface with the islands thereon. Deposition was by magnetron sputtering at a substrate temperature of 500° C. The deposition rate was 6 nm/min. The film exhibited good electrical conductivity (ρ~17 μΩ·cm). Field emission was observed at a nominal field of about 18 V/μm at 1 mA/$cm^2$ current density for an approximately 10 nm thick $LaB_6$ film. Samples with thicker $LaB_6$ films exhibited higher threshold voltages, in substantial conformity with the data of FIG. 8.

EXAMPLE 7

A 10 nm thick $LaB_6$ film was deposited on diamond islands substantially as described in Example 6, except that the substrate temperature during $LaB_6$ deposition was 25° C. The film exhibited poor electrical conductivity (ρ~800 μΩ·cm), and a relatively high emission threshold field.

We claim:

1. An article comprising field emission display means comprising a) a multi-pixel cathode, a given pixel having an area and comprising a multiplicity of spaced apart emitter bodies on a support;

b) an anode that is spaced apart from the cathode and comprises light emitting means;

c) a gate disposed between said anode and cathode; and d) means for applying a voltage between said cathode and gate such that electrons are emitted from at least some of said emitter bodies and impinge on said light emitting means;

CHARACTERIZED IN THAT e) said support comprises first conductive material in contact with said emitter bodies of the given pixel;

f) the emitter bodies of the given pixel comprise in situ grown diamond-comprising islands disposed substantially randomly on said support, said diamond-comprising islands having substantially polyhedral shape, with relatively sharp geometrical features; and g said diamond-comprising islands furthermore comprise second conductive material effective for facilitating electron emission from said diamond-comprising islands.

2. An article according to claim 1, wherein said second conductive material is doped diamond material.

3. An article according to claim 1, wherein said second conductive material comprises a rare earth boride.

4. An article according to claim 3, wherein the rare earth boride is a layer that is at most 30 nm thick.

5. An article according to claim 3, wherein the rare earth boride is selected from the group consisting of the La-borides and the Y-borides.

6. An article according to claim 1, wherein said diamond-comprising islands cover at most 50% of the area of the given pixel.

7. An article according to claim 1, wherein the relatively sharp geometrical features of the diamond-comprising islands are naturally occurring relatively sharp features.

8. An article according to claim 1, wherein the first conductive material is a metal or is a material that has a resistivity in the range $10^6$–$10^9$ Ω·cm.

9. An article according to claim 8 wherein the first conductive material comprises material that has resistivity in the range $10^6$–$10^9$ Ω·cm and is disposed on a conductive layer that is spaced apart from the diamond-comprising islands and is selected to facilitate applying said voltage by capacitative coupling.

10. An article comprising field emission display means comprising:

a) a multi-pixel cathode, a given pixel having an area and comprising a multiplicity of spaced apart emitter bodies on a support;

b) an anode that is spaced apart from the cathode and comprises light emitting means;

c) a gate disposed between said anode and cathode; and d) means for applying a voltage between said cathode and gate such that electrons are emitted from at least some of said emitter bodies and impinge on said light emitting means;

CHARACTERIZED IN THAT e) the emitter bodies of the given pixel are substantially randomly positioned on the support and comprise diamond, a given emitter body having relatively sharp features effective for facilitating electron emission from the emitter body;

f) said gate comprises a patterned metal layer disposed on insulating material that partially encloses said given emitter body, with a portion of said emitter body protruding from said insulating material, the protruding portion being spaced from the patterned metal layer and disposed within an aperture in the patterned metal layer, with the given emitter body being the only emitter body having a protruding portion within the given aperture.

11. Article according to claim 10, wherein the given emitter body comprises pre-existing diamond.

12. Article according to claim 10, wherein the insulating material is material of the type that forms a substantially conformal layer.

13. Article according to claim 10, wherein the given emitter body is an in situ grown diamond-comprising island disposed on the support.

* * * * *